US007938302B2

(12) United States Patent
Gibson

(10) Patent No.: US 7,938,302 B2
(45) Date of Patent: May 10, 2011

(54) WING POCKET ARTICLE CARRIER

(76) Inventor: Scott Gibson, New Paltz, NY (US)

( * ) Notice: Subject to any disclaimer, the term of this patent is extended or adjusted under 35 U.S.C. 154(b) by 1036 days.

(21) Appl. No.: 11/273,136

(22) Filed: Nov. 14, 2005

(65) Prior Publication Data

US 2006/0102676 A1 May 18, 2006

Related U.S. Application Data

(60) Provisional application No. 60/627,957, filed on Nov. 15, 2004.

(51) Int. Cl.
*A45F 3/04* (2006.01)
*A45F 5/00* (2006.01)

(52) U.S. Cl. ..... 224/660; 224/682; 224/662; 224/664

(58) Field of Classification Search ..... 224/637, 224/648, 649, 652, 653, 671, 640, 645, 262, 224/627, 650, 651, 660, 682; D12/216, 217
See application file for complete search history.

(56) References Cited

U.S. PATENT DOCUMENTS 4,491,258 A * 1/1985 Jones ..... 224/153
D312,726 S * 12/1990 Kline ..... D3/224
5,181,638 A * 1/1993 McHale ..... 224/637
5,228,609 A * 7/1993 Gregory ..... 224/617
5,395,023 A * 3/1995 Naymark et al. ..... 224/682
5,407,112 A 4/1995 Christodoulou et al.
D382,110 S 8/1997 Pollari
5,727,720 A * 3/1998 Thatcher ..... 224/664
D404,563 S 1/1999 Rausch
D411,038 S 6/1999 Fair et al.
D425,698 S 5/2000 Paul et al.
6,182,872 B1 * 2/2001 Six ..... 224/148.5
6,202,910 B1 * 3/2001 Swetish ..... 224/627
6,216,926 B1 * 4/2001 Pratt ..... 224/153
6,283,350 B1 9/2001 Gottmeier et al.
6,286,798 B1 * 9/2001 Chun ..... 248/311.2
6,422,439 B1 * 7/2002 Kelliher et al. ..... 224/148.2
6,718,558 B1 * 4/2004 Callanta ..... 2/312
2002/0108982 A1 * 8/2002 Mydans ..... 224/641
2002/0113103 A1 * 8/2002 O'Hare ..... 224/155
2004/0149793 A1 8/2004 Theodore
2004/0195286 A1 10/2004 Greenhalgh et al.

* cited by examiner

*Primary Examiner* — Justin M Larson
*Assistant Examiner* — Adam Waggenspack
(74) *Attorney, Agent, or Firm* — Schmeiser, Olsen & Watts, LLP

(57) ABSTRACT

An article carrier worn around the waist and setting on the back and hips having side entry compartments that are accessible to the person wearing the article carrier while wearing the carrier and a compression system that provides stability of the load being carried.

5 Claims, 9 Drawing Sheets

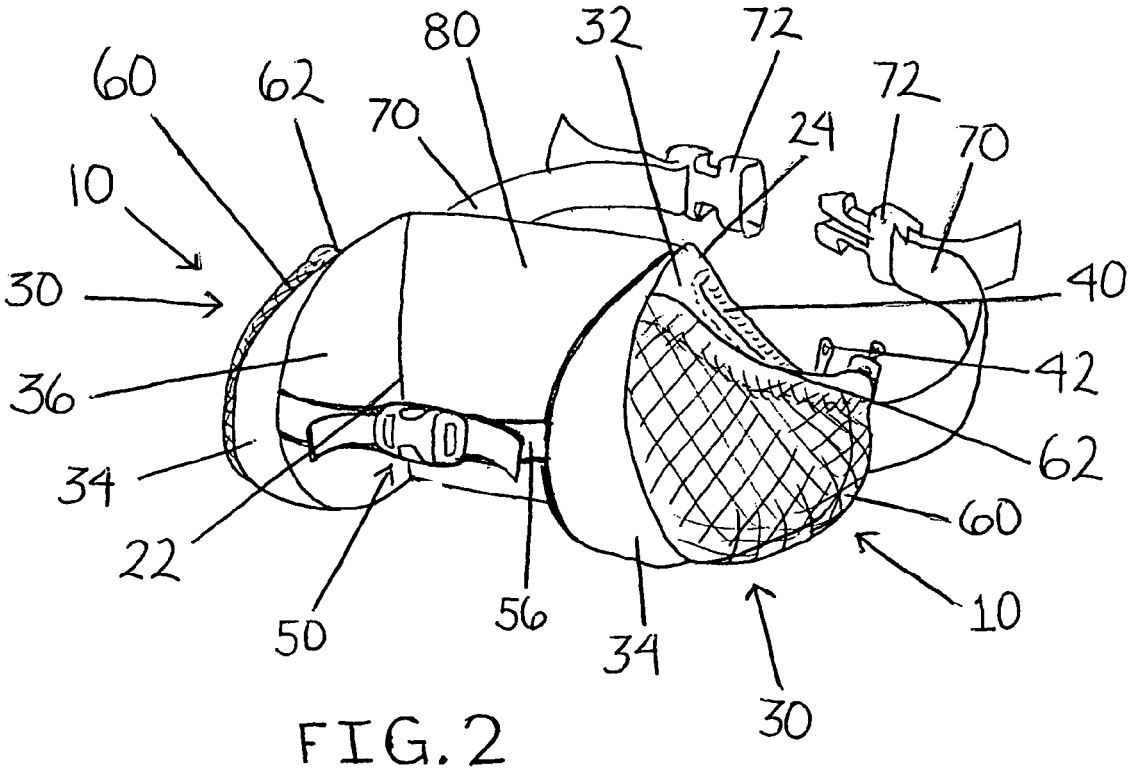
FIG. 2
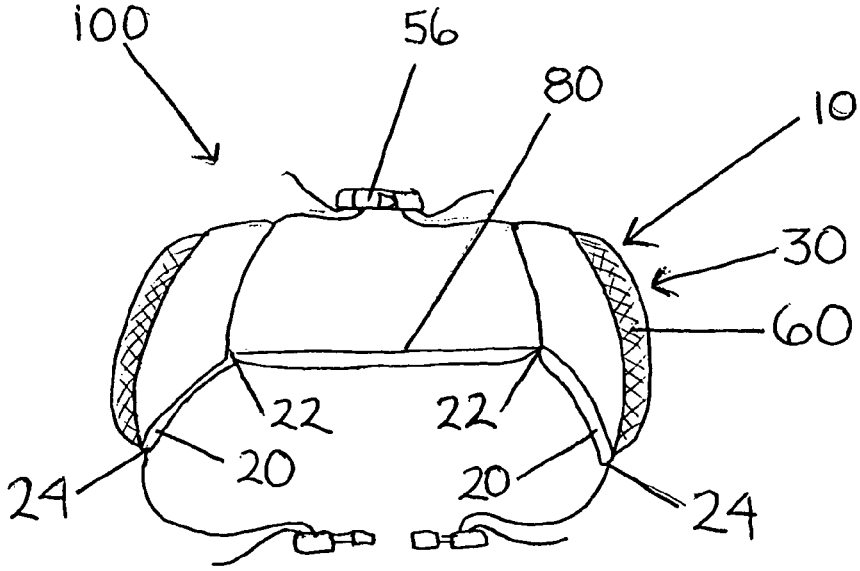
IG. 2A

WING POCKET ARTICLE CARRIER

CROSS REFERENCE TO RELATED APPLICATIONS

This application claims benefit to U.S. Provisional Application No. 60/627,957 filed on Nov. 15, 2004, the contents of which are incorporated in their entirety.

FIELD OF THE INVENTION

The present invention relates generally to the field of article carriers worn on the back by cyclists, motorcyclists, hikers, athletes, walkers, military personnel, construction workers, fishermen, hunters, and persons of the like who would benefit from having an article carrier with pockets for holding items conveniently and safely. More specifically, it relates to an article carrier worn on the back having side compartments with openings accessible to the person wearing the article carrier while it is being worn.

BACKGROUND OF THE INVENTION

Backpacks and fanny packs, both article carriers worn on the back, are worn by people who need an efficient and convenient way to secure a load while allowing them to have the free use of the arms and hands to perform an activity separate from carrying a load. Cyclists, for example, may need to haul personal items while riding the bike. While various bags that affix to the bike, generally referred to as saddle bags, are available, it is often desirable for the rider to carry the items on his person so that the bike is easier to ride though conditions such as mud, rocks or rough terrain. If the cyclist wears a carrier, it will be crucial that the load is stabilized and that the rider is able to sense the weight and shifting of the load so that he may gain greater control of the load.

Similarly, hikers, motorcyclists, athletes, walkers, military personnel, construction workers, fishermen, hunters and others may benefit from wearing a carrier on the back so that articles can be secured without occupying the hands. While it is convenient for the wearer to have use of the arms and hands, access to the contents of existing carriers by the person wearing the carrier is limited while the carrier is worn. Traditionally, items secured in a backpack carrier are not readily accessible to the wearer while the carrier is being worn. In order to ergonomically access the contents, the user must remove the carrier, bring it to the front of his body, and then locate items in the carrier while the carrier is in front of the user. While this may not be an issue for some persons wearing the carrier, for others, this can prevent the access needed or desired during certain activities. A cyclist, for example, would not have convenient access to the contents of the carrier unless he discontinued riding the bike or took the pack off while riding, neither of which is desirable. Thus, there is a need for a carrier worn on the back that is accessible to the person wearing the carrier while the carrier is being worn.

In addition to having compartments that are accessible to the person wearing the carrier, during many activities the comfort and fit of the carrier are crucial to a person wearing it. For example, a long distance cyclist can develop sores if the pack is not adequately secured. A carrier worn on the back that is padded and fits securely to the user to prevent slippage and rubbing is desirable.

It has been found that supporting a weight on one's hips is preferable to supporting the weight solely on the back. At present, there are backpacks and fanny packs that secure to the waist of the person wearing the pack via a waist belt. While some fanny packs, or packs that are approximately the size of a small handbag and traditionally sit on the wearer's lower back, could be rotated around the waist to allow accessibility to the contents, this type of carrier would not have the secure fit or the stability of the contents desired by many users, and wear could result in injuries. Furthermore, fanny packs generally have limited carrying capacity because of their size and shape. Accordingly, there is a need for a carrier that incorporates accessibility to the contents while the carrier is worn, stability of the load, secure fit, a waist belt, and expandable carrying capacity.

SUMMARY OF THE INVENTION

The wing pocket article carrier worn can be worn on the back and fitting around the waist of the person allowing convenient access by the person wearing the carrier to the contents of the wing pockets of the carrier that also increases the stability of the load. In addition to allowing ergonomic access to the contents and stability of the load, providing a secure and comfortable fit and an article carrier having expandable capacity is a feature of the present invention.

A first general aspect of the present invention provides an exterior wing compartment comprising: a back panel; a front sack attached to the back panel; and, an access opening located between the front sack and the back panel such that the access opening when worn by a person is accessible to the person wearing the exterior wing compartment without removal.

A second general aspect of the present invention provides a wing pocket article carrier comprising at least two exterior wing compartments wherein each of the wing compartments includes, a back panel; a front sack attached to the back panel; an access opening located between the front sack and the back panel such that the access opening when worn by a person is accessible to the person wearing the exterior wing compartment without removal; a center section affixed between the at least two exterior wing compartments; and, a waist belt affixed to the at least two exterior wing compartments.

A third general aspect of the present invention provides a wing pocket article carrier comprising a center section; at least one side compartment including a back panel and a front sack, said back panel having a first side attached to said center section and a second side forming an access opening, and said front sack having a first side attached to said back panel and said center section, and a second side forming the access opening; and a belt portion which releasably fastens.

BRIEF DESCRIPTION OF THE DRAWINGS

The features of the present invention will best be understood from a detailed description of the invention and embodiments thereof selected for the purpose of illustration and shown in the accompanying drawings in which:

FIG. 2 depicts an front view of a one embodiment of a wing pocket article carrier;

FIG. 2A depicts a bottom view of a typical wing pocket article carrier;

DETAILED DESCRIPTION OF THE INVENTION

Although certain embodiments of the present invention will be shown and described in detail, it should be understood that various changes and modifications may be made without departing from the scope of the appended claims. The scope of the present invention will in no way be limited to the number of constituting components, the materials thereof, the shapes thereof, the relative arrangement thereof, etc., and are disclosed simply as an example of an embodiment. Although the drawings are intended to illustrate the present invention they do not show every possible configurations or possible location of the elements based upon the teachings of the disclosure, the drawings are not necessarily drawn to scale.

Figure 1:
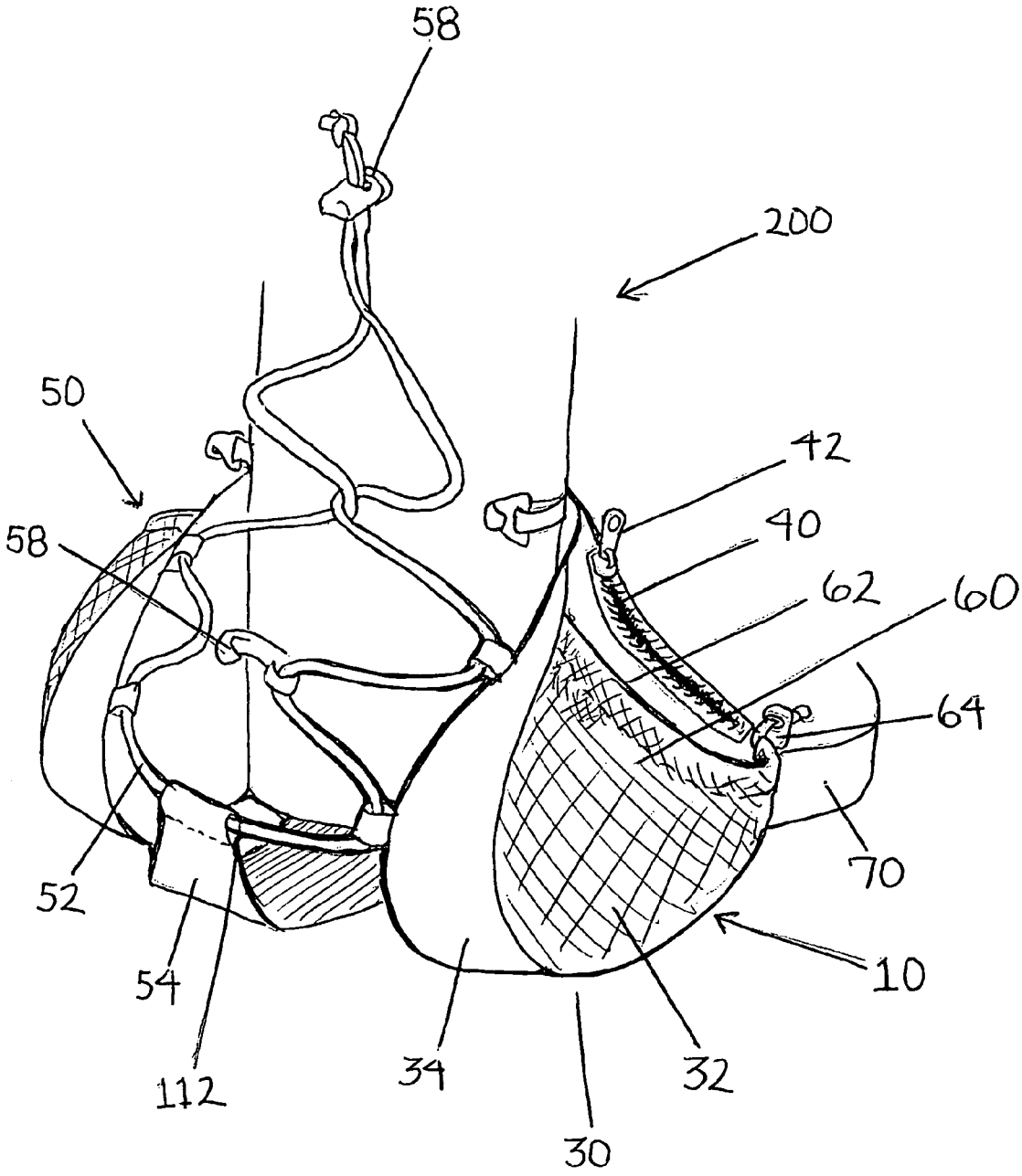
FIG. 1 depicts a front view of an exterior wing pocket for an article carrier.

In FIGS. 1-2 are examples of exterior wing compartment that could be added to any normal backpack, fannypack, waist pack, or any article carrier which sets on back and/or hips of the person wearing the article carrier by surrounding or affixing to the article carrier thus allowing accessability to the contents of the wing carrier. FIG. 2 shows the wing carrier 100 separate from a center carrier 200 that could augment a normal school book bag or small day pack allowing for easy access to items in wing compartment 10. The wing compartment 10 comprising a back panel 20, a front sack 30 attached to the back panel 20. An access opening 40 can be located between the front sack 30 and the back panel 20 such that the access opening when worn by a person is accessible to the person wearing the exterior wing compartment without removal. Optionally there are at least two exterior wing compartments 10, one on each side of the body for symmetry.

When the exterior wing compartments 10 are an add on to the original bag a stabilizing system 50 may affixed to each of the wing compartments to encompass and compress the separate article carrier 200, which is an adjustable strap in FIG. 2. A shoulder strap 396 may be attached to at least one of the at least two exterior wing compartments 100. An optional waist belt 70 is shown affixed to the at least two exterior wing compartments 100 to further stabilize the load. Also shown is optional at least one secondary compartment 60 having an secondary opening 62 adjacent and parallel to the access opening 40.

Figure 13:
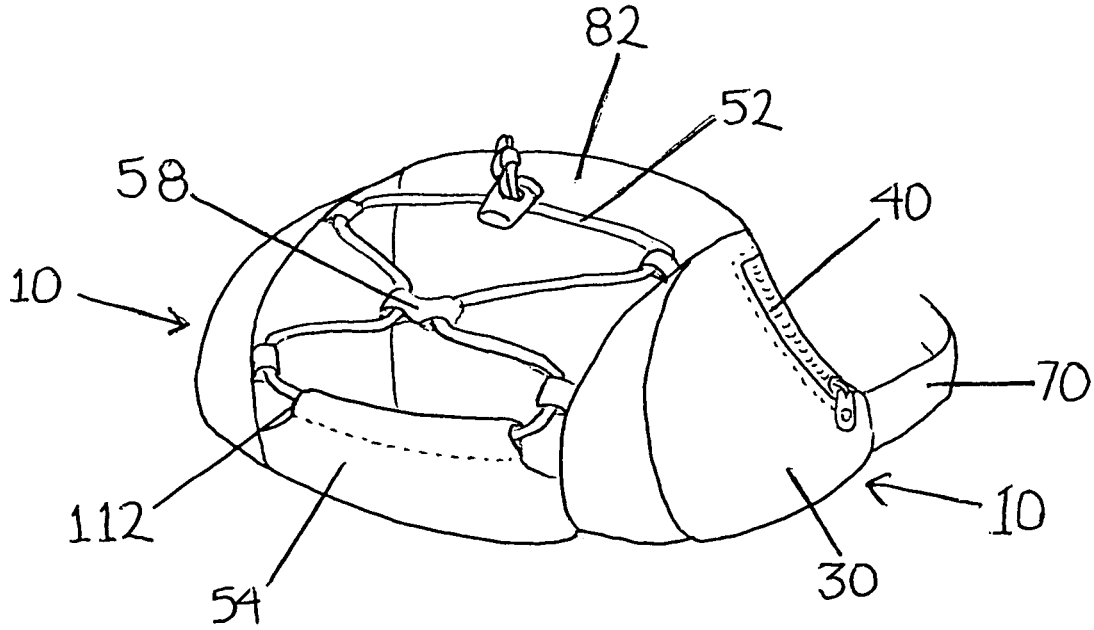
FIG. 13 depicts an isometric front view of an embodiment of a bottom flap and stabilizing system for use on a wing pocket article carrier or a backpack having wing pockets; and, FIG. 14 depicts a front view of a low rider backpack having hinged exterior wing compartments, an adjustable shoulder harness, a pear shape, and a waist belt.

As displayed in FIG. 2A there may be at least two exterior wing compartments 10 and a waist belt 70 affixed to the at least two exterior wing compartments 10. The stabilizing system 50 affixed to each of the back panels of the wing compartments can be a belt with adjustable buckle 56. Optionally a bottom flap 54 as shown in FIG. 13 may be attached to the two wing compartments 10 and the stabilizing system 50. Optionally one can affix permanently a central portion section 200 selected from the group consisting of backpack, fannypack, waist pack, or article carrier which sets on back and/or hips of the person wearing the article carrier wherein the central portion section can be positioned between the at least two exterior wing compartments.

Figure 1A:
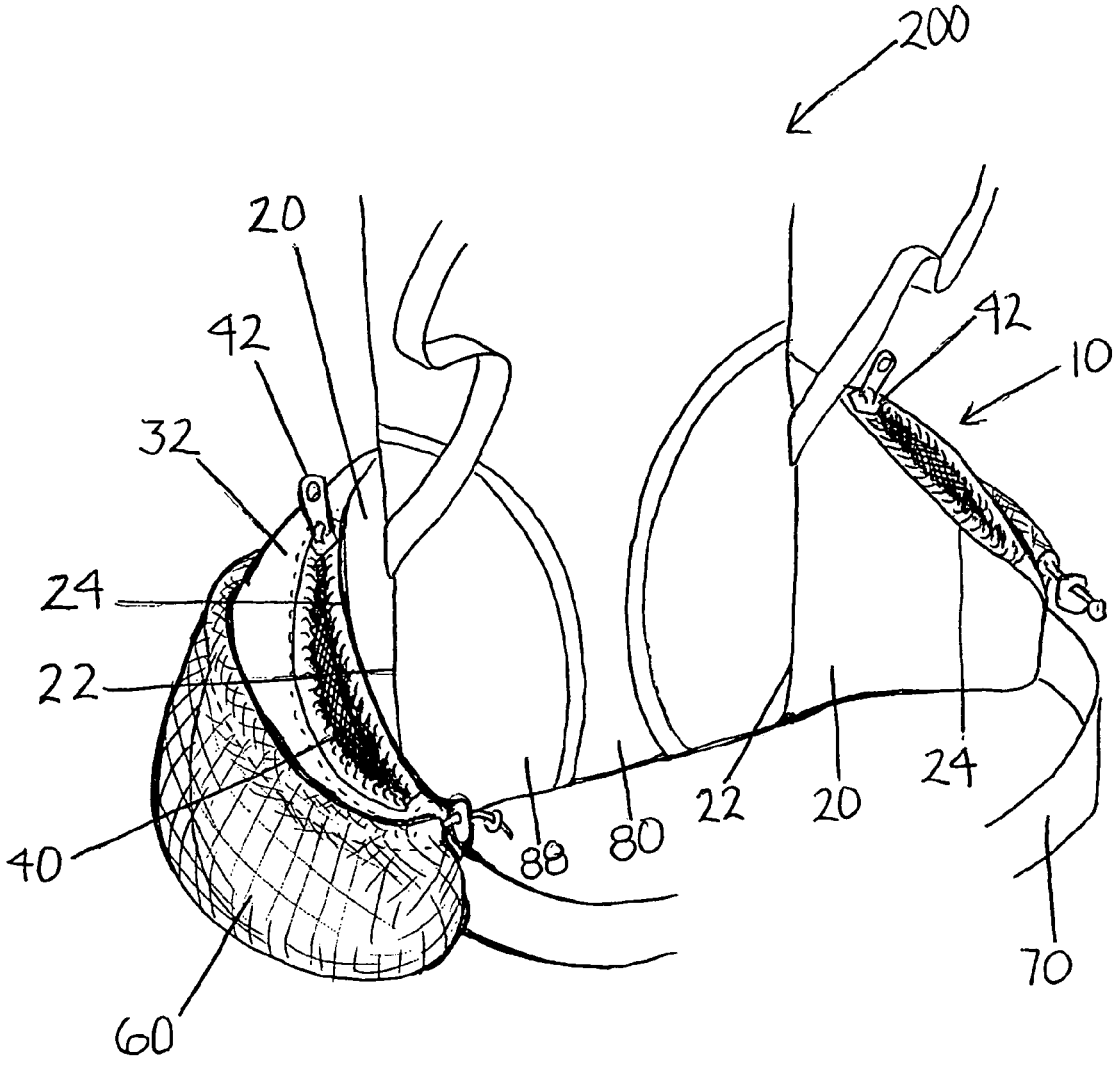
FIG. 1A depicts an isometric back view of a pair of exterior wing pockets attached to an article carrier.

FIGS. 1 and 1A depict an exterior side, or wing, compartment 10, attached to an article carrier 200. The article carrier or central portion 200 may be a backpack, fannypack, waist pack, or any article carrier which sets on back and/or hips of the person wearing the article carrier. The article carrier 200 may have shoulder straps, a waist belt, chest strap or any number of features commonly found on backpacks or fanny packs.

As shown in FIGS. 1 and 1A, the exterior wing compartment 10 can include a side pocket which can attach to a side seam or middle of the back of an article carrier 200 and extends out in a planar fashion from the side seam of the article carrier 200. Generally, the wing compartment 10 can be positioned on the exterior of the article carrier 200. The wing compartments 10 may be permanently attached to an article carrier 200 via sewn seams or any permanent fastener, or may be removable and attached by velcro, snaps, zippers, tie downs or other common removable fasteners.

There may be a wing compartment 10 on one side, or there may be wing compartments 10 on both sides of the article carrier 200. If there is a plurality of wing compartments 10, they may be generally diametric, or symmetric, or they may be different on each side. The wing, or side, compartment 10 can be made out of any fabric, such as leather, canvas, nylon, parachute material, sail cloth, waterproof material, mesh for aeration, or a combination of any of these fabrics. The wing compartment 10 may include a back, or first, panel 20, a front, or first, sack 30, and an access opening 40. The wing compartment 10 may be made from a tube without seams and the access opening 40 can be cut into that tube to form the appropriate angled pocket usually 30-60 degrees in relation to the axis of the waist belt orientation. The front, or first, sack 30 may be made from a single piece of material or a number of material panels sewn together. For example, the front, or first, sack 30 may include a front, or first, wall 32, side, or second, wall 36, and a middle, or third, wall 34.

The back, or first, panel 20, shown in FIG. 1A, may include padding 88 which may be enclosed in a stretchable casing material. The casing material on the back, or first, panel 20 can be mesh, or any breathable fabric to provide comfort and quick drying capability for the benefit of the wearer of the article carrier 200. The back, or first, panel 20 may have a first side 22 and a second side 24 and may be generally triangular (see FIG. 1A), diamond, rectangular, or any shape having at least three sides. The shape may be such that it does not limit the motion of the upper body while being worn. The upper edge of second side 24 adjacent to the wing pocket opening may be defined by the angle of the access opening 40 at the edge and thus second side 24 can have a top edge portion with an angle of 30-60 degrees to the orientation to the axis of the waist belt 70.

The first side 22 of the back, or first, panel 20 can be attached to the side, or second, wall 36 of the front, or first, sack 30 and the second side 24 of the back, or first, panel 20 is attached to the front, or first, wall 32 of the front, or first, sack 30. The front, or first, wall 32 and the side, or second, wall 36 may be attached to form the front, or first, sack 30. However, if a middle, or third, wall 34 is present, it may be attached between the side, or second, wall 36 and front, or first, wall 32. The segments that comprise the wing compartment 10 may be attached with stitching that forms a seam. The seam where the side, or second, wall 36 and the first side 22 of the back, or first, panel 20 meet may be attached to the side of the article carrier 200 such that the wing compartment 10 extends around the waist of the person wearing the article carrier 200.

Figure 3:
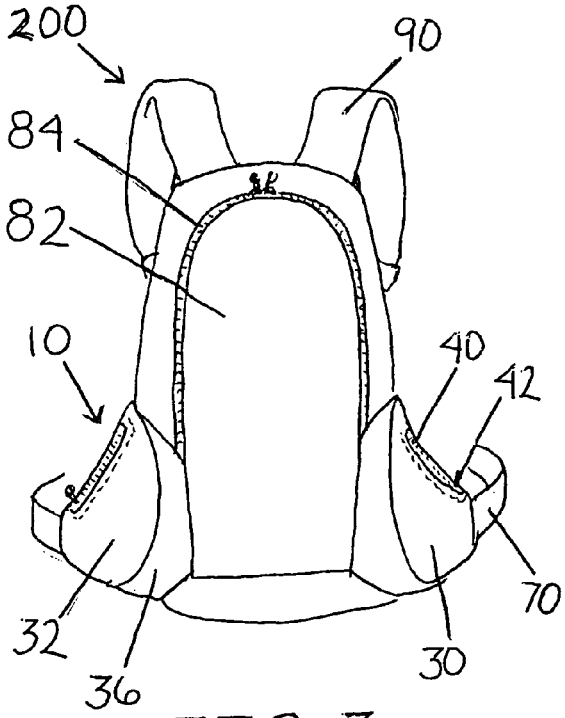
FIG. 3 depicts a front view of a backpack having unhinged exterior wing pockets.
Figure 3A:
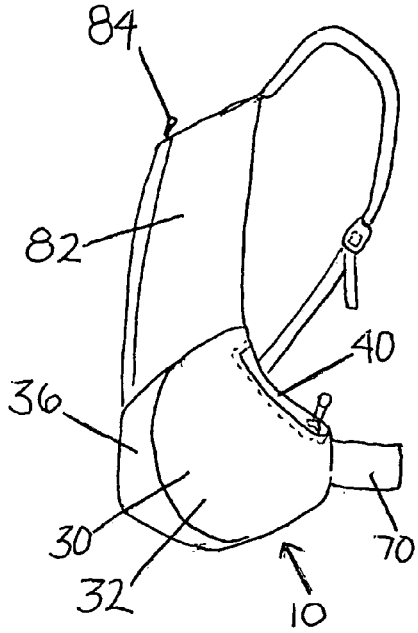
FIG. 3A depicts a side view of a backpack having unhinged exterior wing pockets.
Figure 3C:
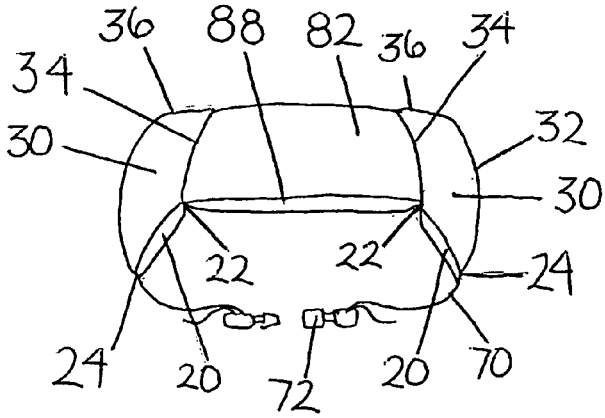
FIG. 3C depicts a bottom view of a backpack having unhinged exterior wing pockets.
Figure 3B:
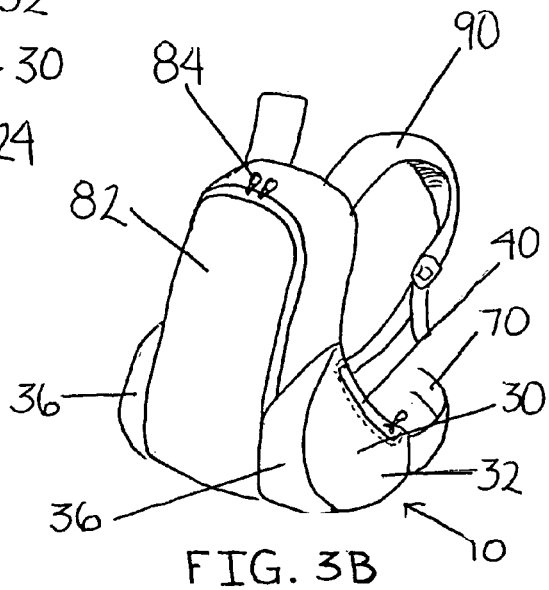
FIG. 3B depicts an isometric front view of a backpack having unhinged exterior wing pockets.

FIG. 1 shows a stabilizing system 50 which secures the wing compartment 10 to the article carrier 200. The stabilizing system 50 may be permanently attached to the wing compartment 10 or may be removable. In addition, the stabilizing system 50 may allow the wing compartment to open on a hinge or to pivot such that a larger load may be accommodated. The wing compartment 10 may also be permanently affixed to the article carrier 200, as shown in FIG. 3. FIG. 1 shows a stabilizing system 50 where the front, or first, sack 30 of the wing compartment 10 may be secured over a portion of the article carrier 200 via lacing 52 or a lacing compression system such that contents that may be inserted between the lacing 52 and the article carrier 200 may be secured. The stabilizing system may also provide the ability to carry loads externally to the article carrier, or center carrier, 200 and also with the load external to the wing compartments 10. For example, a windbreaker or bike helmet may be inserted behind the lacing 52 and be secured. Furthermore, securing the wing compartment 10 over a portion of the article carrier 200 via a stabilizing system 50 may allow the load carried in the wing compartment 10 to wrap around the side of the article carrier 200, which can facilitate transporting loads. The load compressed by the stabilizing system 50 may allow compression of the load into the back, or first, panel 20, which may wrap partially around the waist of the person wearing the article carrier 200. The compression of the load into the back panel 20 may allow the wearer to have greater control of the load and increased awareness of the load.

The stabilizing system 50 may attach to the front sack 30 of the wing compartment 10, and may draw the front sack 30 toward the center of the article carrier 200. In an embodiment where the front sack 30 has a side, or second, wall 36, the side wall 36 may be secured via the stabilizing system 50 such that the side wall 36 may be a panel that compresses the contents of the article carrier 200 that may be in between a pair of wing compartments 10. When left, or first, wing compartment 10 is connected to a right, or second, wing compartment 10 via a stabilizing system 50, the load between the first and second wing compartment 10, generally the load in the article carrier 200, may be compressed for greater load stability. The stabilizing system 50 may be adjustable such that the amount of compression may be customized to accommodate varying loads or a particular wearer's needs. FIGS. 9 through 13 depict various embodiments of a stabilizing system, wherein compression of the load in article carrier 200 to maximize control by the wearer may be obtained.

The stabilizing system 50 may have various fasteners 58 which may allow the system to be customized to fit the user's needs and preferences. The stabilizing system 50 may also have a bottom flap 54. The bottom flap 54 may extend a short distance up the length of the article carrier, or may extend the full length of the article carrier 200. FIGS. 4 through 13 depict various embodiments of a bottom flap 54.

The access opening 40 of the wing compartment 10 may be located in the seam between the front, or first, wall 32 and the back, or first, panel 20 such that the access opening 40 may be accessible to a person wearing the article carrier 200 while the person is still actively wearing the article carrier 100 during activities such as hiking or biking when the load is compressed and removal is inconvenient. The access opening 40 may have a fastener 42 which secures the contents of the wing compartment 10. The fastener 42 may be a zipper, a draw cord, a drawstring, a strap having a buckle, a hook and loop fastener, or any fastener that secures the contents of the wing compartment 10.

FIGS. 1, 1A, and 2 illustrate that the wing compartment 10 may have one or more secondary compartments 60 which overlap the front, or first, sack 30 and provide additional holding capacity. The secondary compartment 60 may overlap a front, or first, wall 32 of the front, or first, sack 30. FIGS. 1, 1A, and 2 show an embodiment having a secondary compartment 60 made of mesh for aeration, however, similar to the wing compartment 10, the secondary compartment 60 may be made of any fabric such as leather, canvas, nylon, parachute material, sail cloth, or waterproof material. The secondary compartment 60 may have an opening 62 which can allow access to the contents of the compartment. The opening 62 may have a fastener 64 which may secure the contents of the secondary compartment 60. The fastener 64 may be a zipper, a draw cord, a drawstring, a strap having a buckle, a hook and loop fastener, or any fastener that secures the contents of the secondary compartment 10.

As shown in FIG. 1A, a waist belt 70 may be attached to the lower portion of the wing compartment 10, generally, to the bottom outer edge of the second side 24 of the back, or first, panel 20. The waist belt 70 is preferably adjustable by the wearer of the article carrier 200 so as to achieve the desired fit.

In one embodiment, shown in FIG. 1A, the back panel 20 may be generally triangular in shape. It is possible to have other shapes as well such as irregular, oval, etc so long as they fit within the spirit of easy access. The top of the second side 24 of the back panel 20 may be attached to a side seam of the article carrier 200, and, when worn, be located behind the hip. The second side 24 of the back panel may slope down to meet the waist belt 70 such that the bottom of the second side 24 is located in front of the hip, and the second side 24 and the access opening 40 wrap around the side of the body to connect to the waist belt 70. In this embodiment, the slope of the access opening provides the desired accessibility. The angle may be such that the wing compartment 10 may not limit the motion of the upper body.

An embodiment of the present invention is depicted in FIGS. 2 and 2A, which show a wing pocket article carrier 100 having a center section 80, wing compartments, or side compartments 10, a stabilizing system 50, and a waist belt portion 70, which may releasably fasten around the waist of the person wearing the article carrier. The wing pocket article carrier 100 may be made out of any fabric or material. For example, the material may be leather, canvas, nylon, parachute material, sail cloth, waterproof material, or mesh for aeration or a combination of any of these fabrics.

As shown in FIG. 2 the center section 80 may be a segment between a pair of side compartments 10. The center section 80 may be a fabric band, a padded section with lumbar support, or be a compartment. The center section 80 may have a fastener that is a zipper, cinch, velcro, etc. While the compartment in the center section 80 would not be as easily accessible to a user while it is being worn, it could provide additional carrying capacity.

As shown in FIG. 2, there may be two side, or wing, compartments 10, one on either side of the center section 80 such that a person wearing the wing pocket article carrier 100 will be able to ergonomically reach the contents of the wing compartments 10 generally by reaching to the side of his waist at the top of the hip. Each of the wing compartments 10 may include a back, or first, panel 20, a front, or first, sack 30, and an access opening 40. When worn, the wing compartments 10 may be situated on the waist and at the top of the hip of the person wearing the article carrier 100. The padded back, or first, panel 20 has a first side 22 which attaches to said center section 80 and a second side 24 which forms an access opening 40. The front, or first, sack 30 may have a first side, or side, or second, wall 36 and a second side, or front, or first, wall 32. The front, or first, sack 30 may also have a middle, or third, wall 34 in between the front, or first, wall 32 and the side, or second, wall 36. The side, or second, wall 36 of the front, or first, sack 30 may be attached in the same seam to the first side 22 of the back, or first, panel 20 and the center section 80. The front, or first, sack 30 may be attached to the second side 24 of the back, or first, panel 20 and forms the access opening 40. The access opening 40 allow a user to access the contents of the wing compartment 10. For example, when worn, a second side 24 of the back panel 20 and the access opening 40 may generally slope from a higher location on the back and behind the hip to a lower location approximately on the waist and in front of the hip. The access opening 40 may have a fastener 42 which secures the contents of the wing compartment 10. The fastener 42 may be accessible to the person wearing the wing pocket article carrier 100. The wing compartments 10 may have more than one compartment. For example, a secondary compartment 60 may overlap the front, or first, wall 32 of the wing compartment 10. The secondary compartment 60 may have a fastener 62 for securing the contents.

Figure 12:
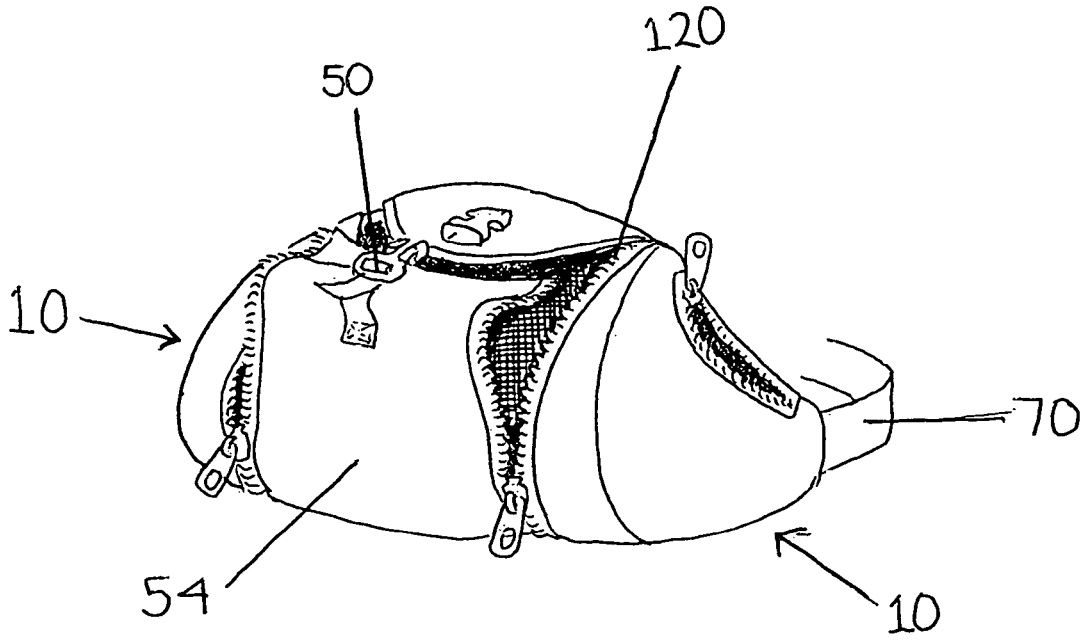
FIG. 12 depicts an isometric front view of an embodiment of a bottom flap and stabilizing system for use on a wing pocket article carrier or a backpack having wing pockets.

The wing pocket article carrier 100 shown in FIG. 2 may include a stabilizing system 50 which secures the wing compartments 10. The stabilizing system 50 may permanently attach the front, or first, sack 30 of the wing compartments 10 to the center section 80 (e.g., FIG. 3). However, there are many configurations in which the stabilizing system 50 may allow the wing compartments 10 to be hingeably attached to the center portion 80. When the wing compartments 10 are hingeably attached, the stabilizing system 50 may allow for adjustability to accommodate the load. The stabilizing system 50 shown in FIG. 2 may be an adjustable buckle and strap 56 attached to said front, or first, sack 30 which secures the side compartments over a portion of the center section 80. However, the stabilizing system 50 for the wing pocket article carrier 100 can be any of a number of arrangements, for example, those shown in FIGS. 12 and 13. FIG. 12 illustrates a wing pocket article carrier 100 having a stabilizing system 50 including a bottom flap 54 which may releasably fasten to the wing compartments 10 via a fastener 120, such as zippers, buttons, clasps or hook and loop fastener may be attached on one side to the bottom flap 54 and attached at the other side to the wing compartment 10. When the fasteners are engaged, another compartment may be formed which overlaps a portion of the center section 80. In addition, the bottom flap 54 may have a top fastener to further secure it to the center section 80 and secure the contents of the compartment formed by zipping or any of the aforementioned fastening of the wing compartments 10 to the bottom flap 54. As shown in FIG. 13, a configuration of the stabilizing system 50 could include lacing, draw cord, or a drawstring, 52, at least one fastener 58, and a bottom flap 54 which may have a channel 112 in which the lacing, draw cord, or draw string, 52 may be laced through. The configuration shown in FIG. 13 may form a compression lacing system which can be used to hold items between the laces 52 and the center portion 80.

Figure 4:
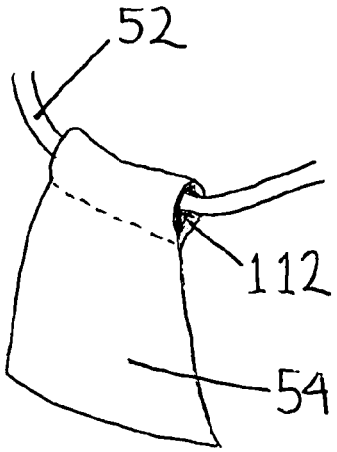
FIG. 4 depicts an isometric front view of an embodiment of a bottom flap for use on a wing pocket article carrier or a backpack having wing pockets.
Figure 5:
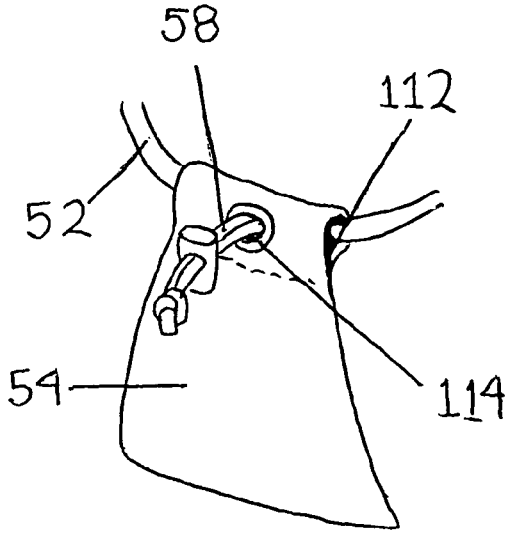
FIG. 5 depicts an isometric front view of an embodiment of a bottom flap for use on a wing pocket article carrier or a backpack having wing pockets.
Figure 6:
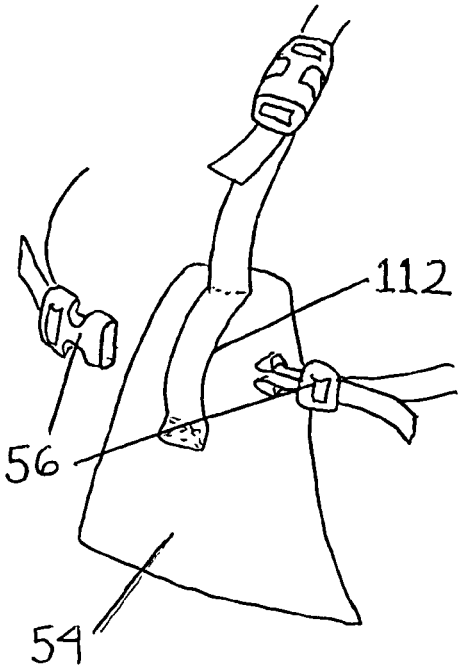
FIG. 6 depicts an isometric front view of an embodiment of a bottom flap and stabilizing system for use on a wing pocket article carrier or a backpack having wing pockets.
Figure 7:
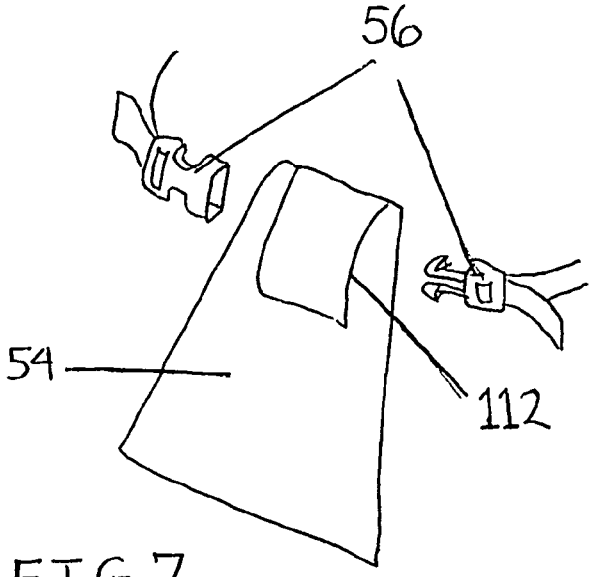
FIG. 7 depicts an isometric front view of an embodiment of a bottom flap and stabilizing system for use on a wing pocket article carrier or a backpack having wing pockets.
Figure 8:
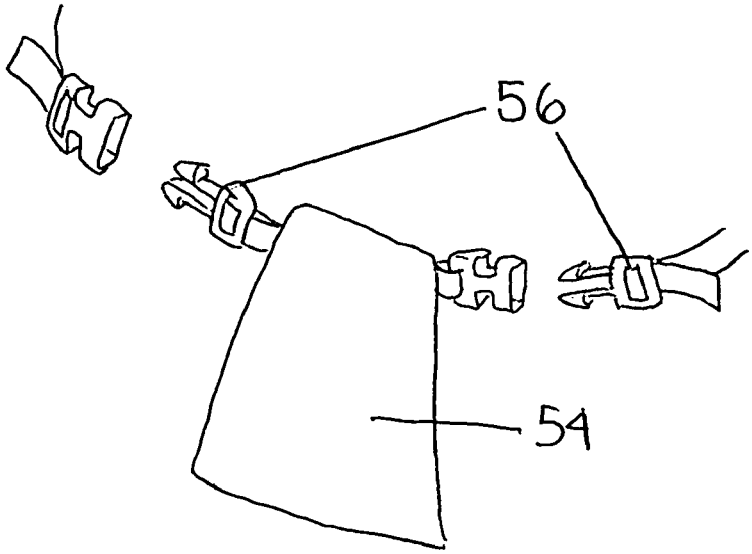
FIG. 8 depicts an isometric front view of an embodiment of a bottom flap and stabilizing system for use on a wing pocket article carrier or a backpack having wing pockets.

FIGS. 4 through 8 depict various configurations of a bottom flap 54 and stabilizing system 50 including a channel 112 through which lacing or cord 52 or straps or other fastener with one or more buckles to compliment fasteners 56 may be fed. For example, FIG. 4 shows a bottom flap 54 having an integrated channel 112 through which lacing, or cord 52, may be fed. FIG. 5 shows a bottom flap 54 having an integrated channel 112 through which lacing, or cord 52, may be fed. The channel 112 may have an eyelet 114 through which the lacing or cord 52 may be fed and secured by an adjustable fastener 58. FIG. 6 illustrates a bottom flap 54 having a channel 112 that may be formed from a strap that attaches to the top portion of the center section 80 of the carrier 100. A strap having an adjustable fastener 56 may be fed through the channel 112. FIG. 7 shows the bottom flap 54 having a channel 112 formed from a strap that attaches to the front of the bottom flap 54. The fastener includes straps having buckle members 56. FIG. 8 depicts a bottom flap 54 having an integrated channel 112 having a plurality of straps and clips 56.

Another embodiment of the present invention may be a backpack having exterior wing compartments 200 as illustrated in FIGS. 3, 3A, 3B, 3C, 9, 10 and 11. The backpack having exterior wing compartments 200 may have a center compartment 82, shoulder straps 90, a pair of wing compartments 10, and a waist belt 70. As shown in FIG. 3, the center compartment 82 may be a full size backpack and extend fully up to the shoulders of the person wearing the backpack 200, or the center compartment 82 can resemble a fanny pack which extends partially up the wearer's back. There may be one or more auxiliary compartments within the center compartment 82 for further segmenting the contents. The center compartment 82 may have a fastener 84 which secures the contents of the center compartment 82. The fastener 84 may be a zipper, a draw cord, a strap and buckle, or any fastener which secures the opening of the center compartment 82. The back of the center compartment may have padding 88 enclosed in a stretchable casing.

Figure 14:
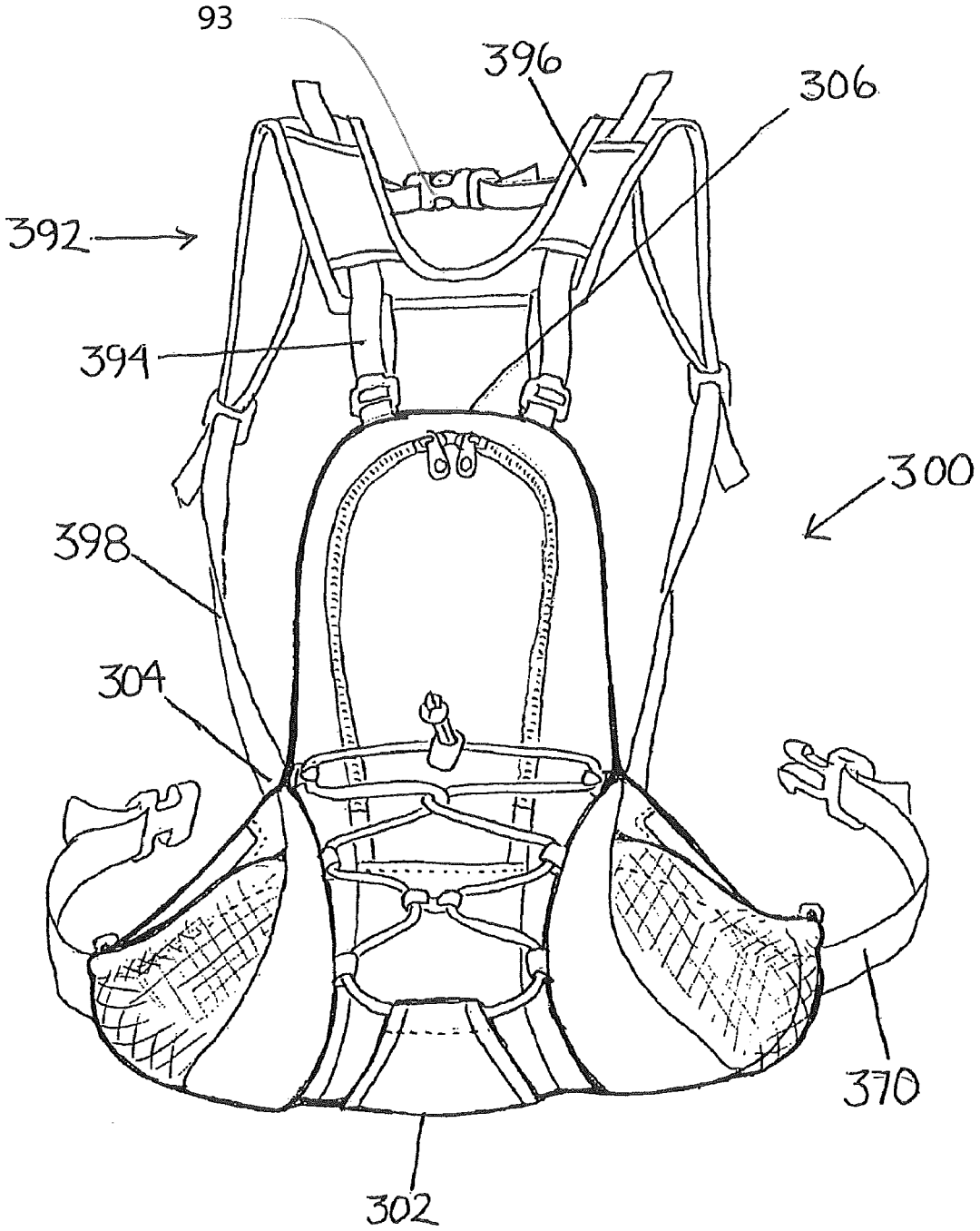

Shoulder straps 90 may attach to the top portion of the center compartment 82 and may be adjustable for fit. In addition, the shoulder straps may have a chest strap 93 which further secures the pack, a panel forming a compartment on the shoulder strap, and other accessories that customize the backpack. As shown in FIG. 14, the shoulder straps 90 may be attached to the top of the center compartment 82 by adjustable buckles and webbing to allow custom fitting and the opportunity to lower the bag by adjusting the shoulder straps 90.

Figure 9:
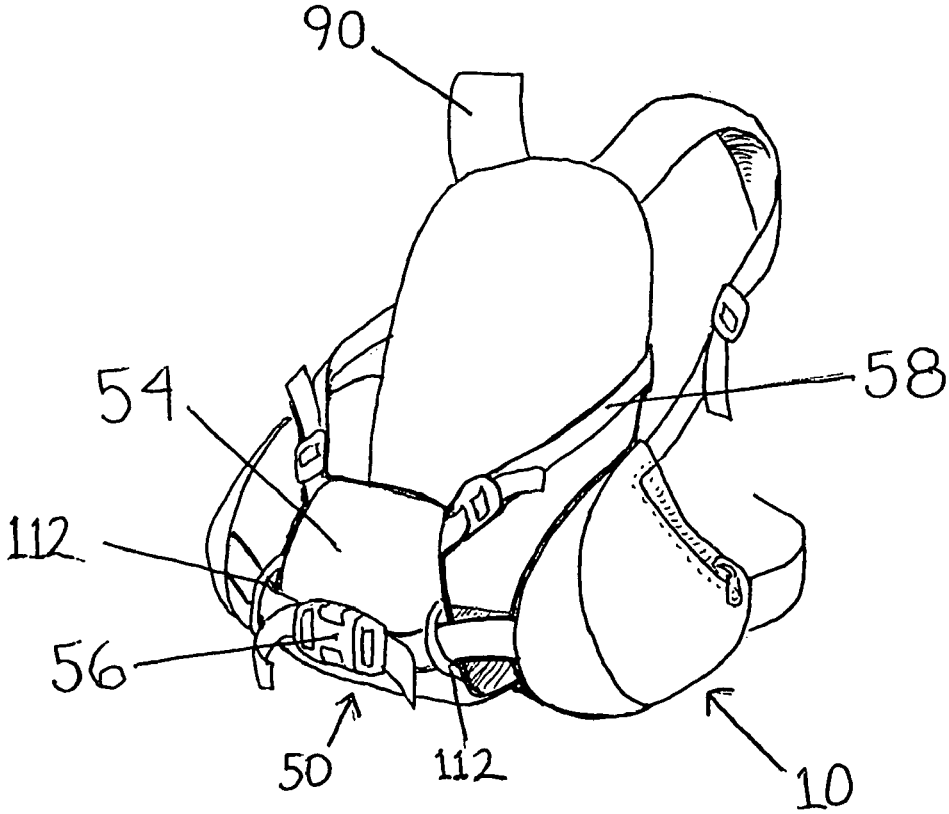
FIG. 9 depicts an isometric front view of an embodiment of a bottom flap and stabilizing system for use on a wing pocket article carrier or a backpack having wing pockets.
Figure 10:
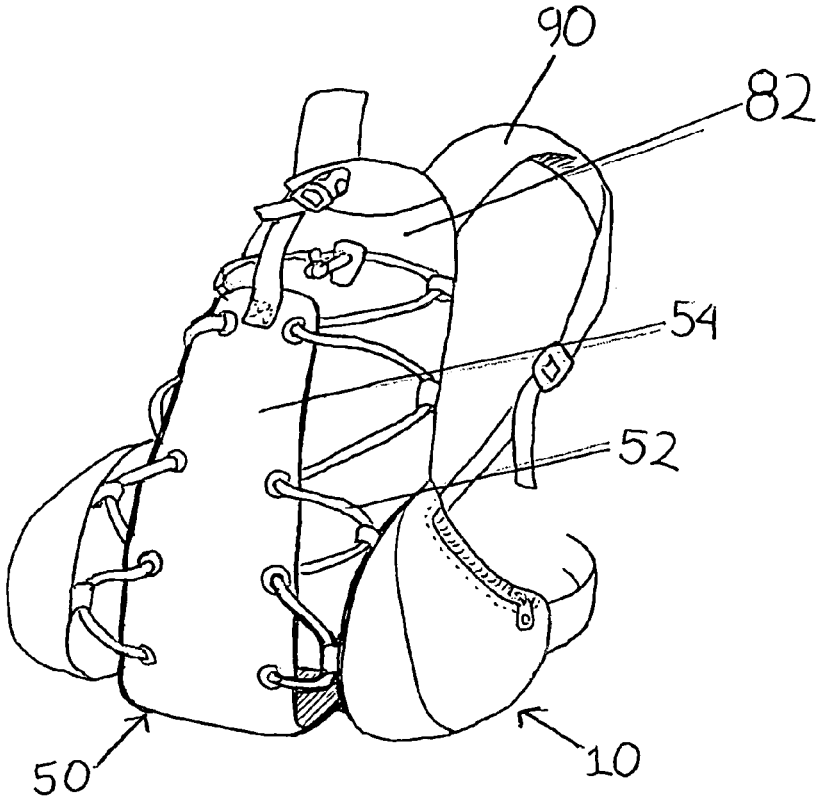
FIG. 10 depicts an isometric front view of an embodiment of a bottom flap and stabilizing system for use on a wing pocket article carrier or a backpack having wing pockets.
Figure 11:
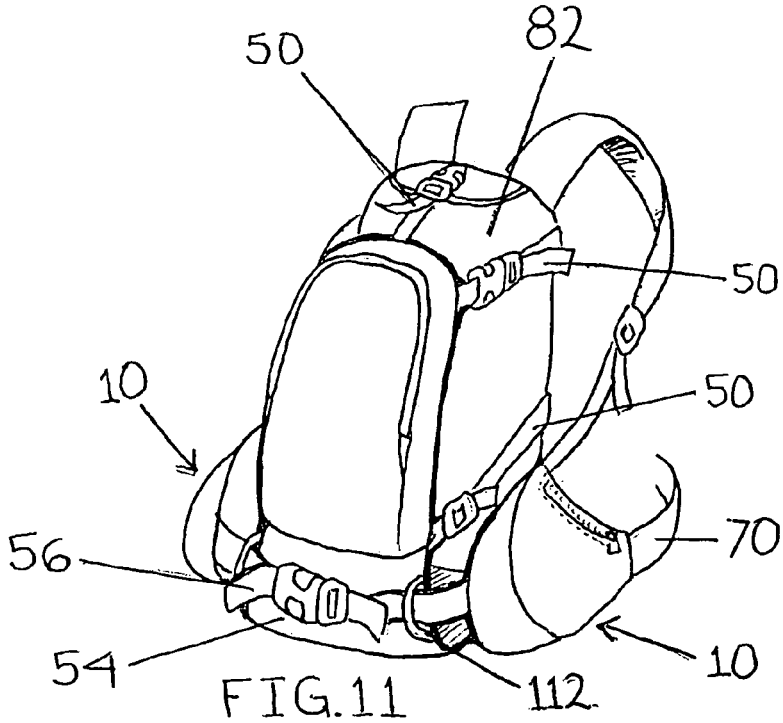
FIG. 11 depicts an isometric front view of an embodiment of a bottom flap and stabilizing system for use on a wing pocket article carrier or a backpack having wing pockets.

As shown in FIGS. 9, 10, and 11, the pair of wing compartments 10 may attach to the sides of the middle compartment 82 such that the right, or second, wing compartment 10 may hingably attach to the right, or second, side of said middle compartment 82 and the left, or first, wing compartment 10 may hingably attach to the left, or first, side of said middle compartment 82. However, as shown in FIG. 3, the wing compartment 10 may be fixedly secured to the center compartment, so that it is not hinged. Regardless of whether hinged or not hinged, when worn, the left, or first, wing compartment and the right, or second, wing compartment may extend partially around the waist of the person wearing the backpack 200. Furthermore, an adjustable waist belt 70 may releasably attach around the waist of the person wearing the backpack may be attached to the outermost tip of each of the wing compartments 10 and may fasten around the wearer's waist.

The embodiment shown in FIG. 14 is a low rider pack, 300 having a low rider system that may allow the pack 300 to be adjusted so that the load is not placed high on the wearer's back which prevents a cantilevered weight during an activity such as cycling. The pack 300 may ride on the lower back, closer to the body's center of gravity and may lower the load on the wearer of the pack 300. The low rider pack is a wing pocket article carrier as disclosed above having an adjustable shoulder harness 392, a generally pear shape, and a waist belt extending from the widest part of the pear shape.

The adjustable shoulder harness 392 may be attached to the top of the pack 300 by adjustable buckles and webbing. The harness may have two top, or first, straps, 394 a middle, or second, strap, 396 and two bottom, or third, straps 398. There may be a chest strap 393 on the harness 392. The shoulder harness 392 may allow for custom fitting and may provide the opportunity to lower the pack 300 by adjusting the straps. The shoulder harness 392 may have attachments such as pockets, clips, loops, or any feature which may allow the wearer to conveniently access or carry items.

The shape of the pack 300 may resemble a pear in that it is wider across the bottom, or first side, 302 and has sides which may angle to meet the top, or second side, 306. The top 306 has a width that may be approximately one-half of the width of the bottom 302. The pear shape can disperse more of the pack's contents and weight across the lower back of the person wearing the pack and allows the wearer to have full upper body movement.

The waist belt 370 may be attached at the widest part of the pear shape at the edges of the bottom 302. The bottom 302 of the pack 300 may extend below the waist belt 370, which, when worn, may allow the weight of the load to be lowered below the waist and dispersed across the sacrum. The shoulder strap 392 may be attached above the waist belt 370 and may be attached on the angled portion 304 of the pear shape or to the first side 22 of the back panel 20 of the wing compartment 10.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims. The claims provide the scope of the coverage of the invention and should not be limited to the specific examples provided herein.

I claim:

1. A wing pocket article carrier comprising:

a flexible middle compartment having a fastening device to form an accessible enclosure having an interior carrying capacity, wherein the flexible middle compartment has padding housed in a stretchable casing attached thereto;

a first side compartment including a first back panel forming a first portion of a waist belt, the first back panel wrapping partially around a user's waist when the article carrier is in a fastened position to accommodate some of an external load transferred from an adjustable stabilizing system positioned on the user's backside, the first side compartment also including a first front sack, said first front sack forming a part of the adjustable stabilizing system, said first back panel having a first side directly attached to said middle compartment, a second side forming a first access opening, and a third side attaching to said waist belt, wherein said first front sack is defined by a first plurality of walls attaching to said middle compartment, said first access opening, and said waist belt, creating said first side compartment that, when in the fastened position, extends forward from said middle compartment attaching to said waist belt and also extends behind said middle compartment to form a part of said adjustable stabilizing system, wherein the adjustable stabilizing system is configured to customizably compress the external load to provide greater load stability;

a second side compartment including a second back panel forming a second portion of a waist belt, the second back panel wrapping partially around a user's waist when the article carrier is in the fastened position to accommodate some of the external load transferred from the adjustable stabilizing system positioned on the user's backside, the second side compartment also including a second front sack, said second front sack forming a part of an adjustable stabilizing system, said second back panel having a first side directly attached to said middle compartment a second side forming a second access opening, and a third side attaching to said waist belt, wherein said second front sack is defined by a second plurality of walls attaching to said middle compartment, said second access opening, and said waist belt, creating said second side compartment that, when in the fastened position, extends forward from said middle compartment attaching to said waist belt and also extends behind said middle compartment to form a part of said adjustable stabilizing system, wherein the adjustable stabilizing system is configured to customizably compress the external load to provide greater load stability;

wherein each of the first and second side compartments are angled between 30° and 60° in relation to the user's hips, when in the fastened position.

2. The article carrier of claim 1, wherein each of the first and second side compartment further includes a triangular back panel, wherein the first and second access opening is located on an exterior side seam of the first and second side compartment so that it is accessible to a person wearing the article carrier.

3. The article carrier of claim 1 further comprising:

at least one shoulder strap;

a plurality of securing members such that said adjustable stabilizing system secures said first and second front sacks over at least a portion of said middle compartment.

4. The article carrier of claim 1 further comprising:

a chest strap, wherein the chest strap connects to the shoulder straps.

5. The article carrier of claim 1 further comprising:

a middle strap to adjust compression of the middle compartment.

* * * * *